United States Patent [19]

Watson

[11] 3,968,350

[45] July 6, 1976

[54] ARTICLE LABELING APPARATUS AND LABEL FORM THEREFOR

[75] Inventor: Donald W. Watson, Arlington Heights, Ill.

[73] Assignee: Xerox Corporation, Stamford, Conn.

[22] Filed: Oct. 22, 1974

[21] Appl. No.: 517,274

Related U.S. Application Data

[62] Division of Ser. No. 379,977, July 17, 1974.

[52] U.S. Cl. ..... 235/61.12 N; 283/18

[51] Int. Cl.[2] ..... G06R 19/00

[58] Field of Search ..... 235/61.12 N, 61.6 R; 283/18, 21

[56] References Cited

UNITED STATES PATENTS

| | | | |
|---|---|---|---|
| 2,124,906 | 7/1938 | Bryce | 235/61.12 N |
| 3,641,319 | 2/1972 | McGuire | 235/61.12 R |

*Primary Examiner*—Vincent P. Canney

[57] ABSTRACT

Improved article labeling apparatus is provided in accordance with the teachings of the present invention wherein individual labels are derived from an array of printed labels and affixed to articles transported to a label applying station. The array of printed labels includes a label field and a label identifying field. The label field comprises a plurality of rows and at least one column of printed labels. The label identifying field comprises indicia associated with corresponding rows of labels, the indicia associated with a row serving to identify the information borne by a predetermined label in the associated row. The array of printed labels is adapted to be advanced to the label applying station and, concurrent with the advance of said array, the label identifying field is scanned to generate representations of the indicia. Means coupled to the scanning means and responsive to the generated representations are provided for determining if the information borne by a predetermined label corresponds to preselected information. When it is determined that the predetermined label bears information corresponding to the preselected information, a predetermined operation of the article labeling apparatus is initiated.

This invention relates to improved automatic labeling apparatus and, in particular, to automatic labeling apparatus wherein individual labels are derived from an array of printed labels, and an improved label form therefore.

4 Claims, 2 Drawing Figures

ARTICLE LABELING APPARATUS AND LABEL FORM THEREFOR

This is a division, of application Ser. No. 379,977, filed July 17, 1974.

BACKGROUND OF THE INVENTION

In various technical arts and commercial endeavors, it has been found necessary to apply information bearing labels to numerous articles. To accomplish this tedious task, the prior art has developed automatic article labeling apparatus, thus permitting human skill and capabilities to be directed toward more useful and satisfying pursuits while highly accurate and efficient operation may be obtained from machines. A successful utilization of automatic article labeling apparatus has been achieved in bulk mailing applications. Where information material, such as promotional brochures, advertising circulars, subscriptive material or the like, are prepared for mass distribution, it is highly advantageous to prepare address labels bearing information regarding the respective recipients of such material and to then apply each such label to a corresponding article. The thus addressed article is conditioned to be effectively mailed to the indicated recipient.

In preparation of articles for bulk mailing, it is often desired to classify the addressed material according to predetermined categories. For example, where general information material is to be distributed to all recipients but specific information is to be added and distributed to a special category of recipient, it might be necessary to characterize the material addressed to such categorized recipient so that the additional information may be provided. Hence, if documents are automatically deposited in envelopes and each envelope is subsequently supplied with an address label bearing information regarding the particular recipient of such envelope, it might be preferred to identify those envelopes addressed to, for example, doctors to thereby permit further documents to be deposited therein. When the last envelope addressed to a generalized recipient is processed a particular operation may be executed to segregate the envelopes addressed to the generalized recipients from the subsequent envelopes addressed to the specialized recipients, i.e., the doctors. Such operation may comprise the introduction of a predetermined machine operation delay to thereby provide a substantial dimensional hiatus between the envelopes addressed to the generalized recipients and those envelopes addressed to the specialized recipients to enable an operator to recognize the latter envelopes and to deposit the particular inserts therein. Alternatively, the initial envelope addressed to the specialized recipients may be skewed or particularly marked to thus characterize such envelope. In this manner, an operator may readily recognize the specialized envelopes, thereby facilitating the addition of particular inserts thereto.

Various other classification of recipient may be employed to effect the initiation of a predetermined operation. For example, such operation may be initiated upon detecting the presence of the last envelope included in a post office zip code group. It has been found that, in most instances wherein a predetermined operation is to be executed, such operation being dependent upon the particular classification of recipients employed, the information regarding such classification may generally be borne by the address label itself. Hence, in accordance with the foregoing examples, the title of a doctor will normally appear on the face of the address label. Similarly, the post office zip code associated with the recipient to which the address label is addressed will appear on the face of the label.

The prior art has developed techniques for initiating a predetermined operation upon detecting predetermined labels that manifest the desired classifications. For example, a mailing piece separator has been proposed wherein the first mailing piece directed to an address in a given geographic area is skewed with respect to the remaining mailing pieces. An operator may then recognize when mailing pieces for such different geographic areas have been processed by the labeling apparatus and can, accordingly, separate such mailing pieces into appropriate individual bundles suitable for proper distribution. This prior art technique requires that a predetermined label be provided with appropriate markings thereon representing said given geographic area such that the marked label and associated mailing piece may be detected. Unfortunately, it has been found that this technique requires the printing of address labels with a degree of care not necessarily required for most bulk mailing operations to insure the proper marks thereon. Furthermore, mark sensing means must be disposed in the processing path of the labels, which sensing means are usually disposed immediately prior to the label applying station, thus occupying much needed space at a critical point in the processing path. Additionally, such sense marks that must be provided on the faces of the labels themselves might detract from a preferred appearance of the labels and, moreover, comprise a permanent part of the address label. Typical apparatus employing the concepts of this technique are disclosed in U.S. Pat. No. 3,507,211 issued to H. V. Kirk et al.

An alternative proposal for an automatic article labeling system contemplates the use of a general purpose digital computer to produce appropriate address labels. As is recognized by those familiar with the computer art, a compilation of recipients and their addresses may be readily stored and revised by a digital computer. Such information may be easily retreived and reproduced as actual address labels in the form of a conventional computer print-out. It has been found that, in addition to printing the appropriate address labels, the computer may be advantageously employed to provide control data to enable a selective sorting of labeled articles in accordance with a particular program or labeling scheme. This technique is disclosed in U.S. Pat. No. 3,641,319 issued to John W. McGuire and assigned to Xerox Corporation, the assignee of the present invention. In this patented system, the control data is provided as sense marks in a disposable column attached to the computer print-out sheet of address labels. The printed labels are disposed in a plurality of rows and columns, at least one row of which is associated with control data located in the disposable column. The control data is capable of initiating a separation of labeled articles in accordance with the post office zip code number included in the address. Additionally, the control data is capable of initiating an article processing operation whereby one or more articles are not supplied with associated address labels. Furthermore, the control data is capable of controlling an article "skip" procedure such that "skipped" labels are not applied to articles but are stored for future use. More particularly, the disposable column is divided into a plurality of columns and rows. The presence of a sense mark in a particular column determines the particular function to be executed. For example, if a sense mark is disposed in a first column, a "zip sort" function is performed wherein labeled articles are separated in accordance with their post office zip code numbers. The location of a sense mark in a second column permits a "label skip" operation to be performed wherein a number of articles are processed without applying labels thereto. A sense mark disposed in a third column enables the performance of an "article skip" operation whereby a number of labels are stored for future use without being applied to associated articles. The control data positioned in the disposable column are further divided into a plurality of rows equal in number to the number of labels located in a given row of labels. In this manner, the function specified by the particular column in which a sense mark is disposed is performed upon that label represented by the particular row in which the sense mark is located. For example, a sense mark positioned in column one, row one, represents that the first label in an associated row of labels is the last label in a zip code group and, therefore, that an article separation operation is to be performed. Hence, after that first label is applied to an article, operation of the article labeling machine is interrupted for a determined time interval. Upon resuming operation, a suitable separation is provided between zip code groups. As another example, a sense mark located in the second column, second row represents that the second label in an associated row of labels is to be the last label affixed to a group of articles. Consequently, upon applying the second label in that row of labels to an article, a preset number of articles are subsequently processed but not labeled. As a further example, a sense mark located in the third column, third row represents that the third label located in an associated row of labels is the last label to be applied to a group of articles and subsequent labels are to be merely stored for future use. Hence, when the third label in that row of labels is affixed to an article, a preset number of labels are processed but not applied to articles.

Although the aforedescribed article labeling apparatus advantageously permits the execution of predetermined operations upon labeled articles in accordance with a predetermined program that also functions to control a digital computer, it has been found that this technique is, for many applications, unduly inflexible. More particularly, the control data disposed in the disposable column and, therefore, the predetermined machine operations associated therewith, bear no relation to the actual information borne by each address label. The position of a label in a row of labels may be identified but there is no capability of identifying the useful information borne thereby. Thus, if it is desired to perform a predetermined machine operation upon dectecting various classifications of labels, it is necessary to revise the computer program which serves to print the label form and associated disposable column. This obtains because there is no provision for distinguishing between label classifications. In the patented apparatus, a predetermined machine operation will be executed, for example, upon detecting control data in a first data column associated with a row of labels. This operation will be performed whenever control data is positioned in said column. An operator cannot selectively initiate such machine operation in accordance with the useful information borne by the labels. It is merely the presence of control data in that first column that determines the initiation of machine operation.

In many applications, it is preferable to permit an operator to automatically enable the initiation of a machine operation upon detecting certain labels bearing predetermined information. For example, in bulk mailing operations it might be desirable to segregate labeled articles in accordance with post office zip code numbers. Similarly, such segregation might be desired in accordance with various characteristics of the recipient of the addressed article. For example, a predetermined operation may be executed upon articles having labels addressed to doctors. As a further example, a particular operation may be performed upon articles bearing labels to subscribing recipients whose subscription may be expiring. Unfortunately, an operator of the apparatus described by the McGuire patent is not provided with the capability of performing such operations on selected labels in accordance with the actual information borne thereby, i.e., on some of the labeled articles but not all. Accordingly, a need has arisen for identifying the useful information borne by labels as well as the unique location of particular ones of said identified labels. By providing such information identification, the aforementioned machine operations may be performed in accordance with post office zip code numbers, for example, in one instance and in accordance with characteristics of the recipients of the labeled articles in another instance without requiring a complete revision in the program of the computer that controls the compilation and printing of such labels.

OBJECT OF THE INVENTION

Therefore, it is an object of the present invention to provide improved automatic article labeling apparatus wherein a predetermined operation of the apparatus is initiated when the information borne by a predetermined label corresponds to preselected information.

It is another object of the present invention to provide improved automatic article labeling apparatus operable upon an array of printed labels wherein said array includes a label field and a label identifying field.

A further object of this invention is to provide an array of printed labels for use in automatic labeling apparatus wherein said array includes a label field having a plurality of rows and at least one column of printed labels and a label identifying field having coded sense marks to identify the information borne by at least one of the printed labels and to identify a predetermined one of the printed labels bearing said identified information.

A still further object of the instant invention is to provide improved automatic article labeling apparatus for scanning an array of printed labels prior to the derivation from said array of individual labels to thereby control the initiation of predetermined operations of said apparatus in accordance with the information borne by predetermined labels included in said array.

Yet another object of the present invention is to provide improved automatic article labeling apparatus capable of performing operations in accordance with indicia provided on an array of printed labels, which indicia serves to identify the information borne by predetermined labels included in said array.

Various other objects and advantages of the present invention will become clear from the following detailed description of an exemplary embodiment thereof, and the novel features will be particularly pointed out in connection with the appended claims.

SUMMARY OF THE INVENTION

In accordance with this invention, improved automatic article labeling apparatus wherein individual labels are derived from an array of printed labels and affixed to corresponding articles transported to a label applying station is provided wherein said array of printed labels includes a label field comprising a plurality of rows and at least one column of printed labels and a label identifying field comprising indicia associated with corresponding rows of labels, the indicia associated with a row serving to identify the information borne by a predetermined label in said associated row; said label identifying field is scanned as said array of printed labels is advanced to the label applying station; the scanned label identifying field is examined to determine if the information borne by a predetermined label corresponds to preselected information; and a predetermined operation of the automatic article labeling apparatus is initiated if it is determined that said predetermined label bears said preselected information.

BRIEF DESCRIPTION OF THE DRAWING

The invention will be more clearly understood by reference to the following detailed description of an exemplary embodiment thereof in conjunction with the accompanying drawings in which.

DETAILED DESCRIPTION OF THE INVENTION

Article Labeling Apparatus

Figure 1:
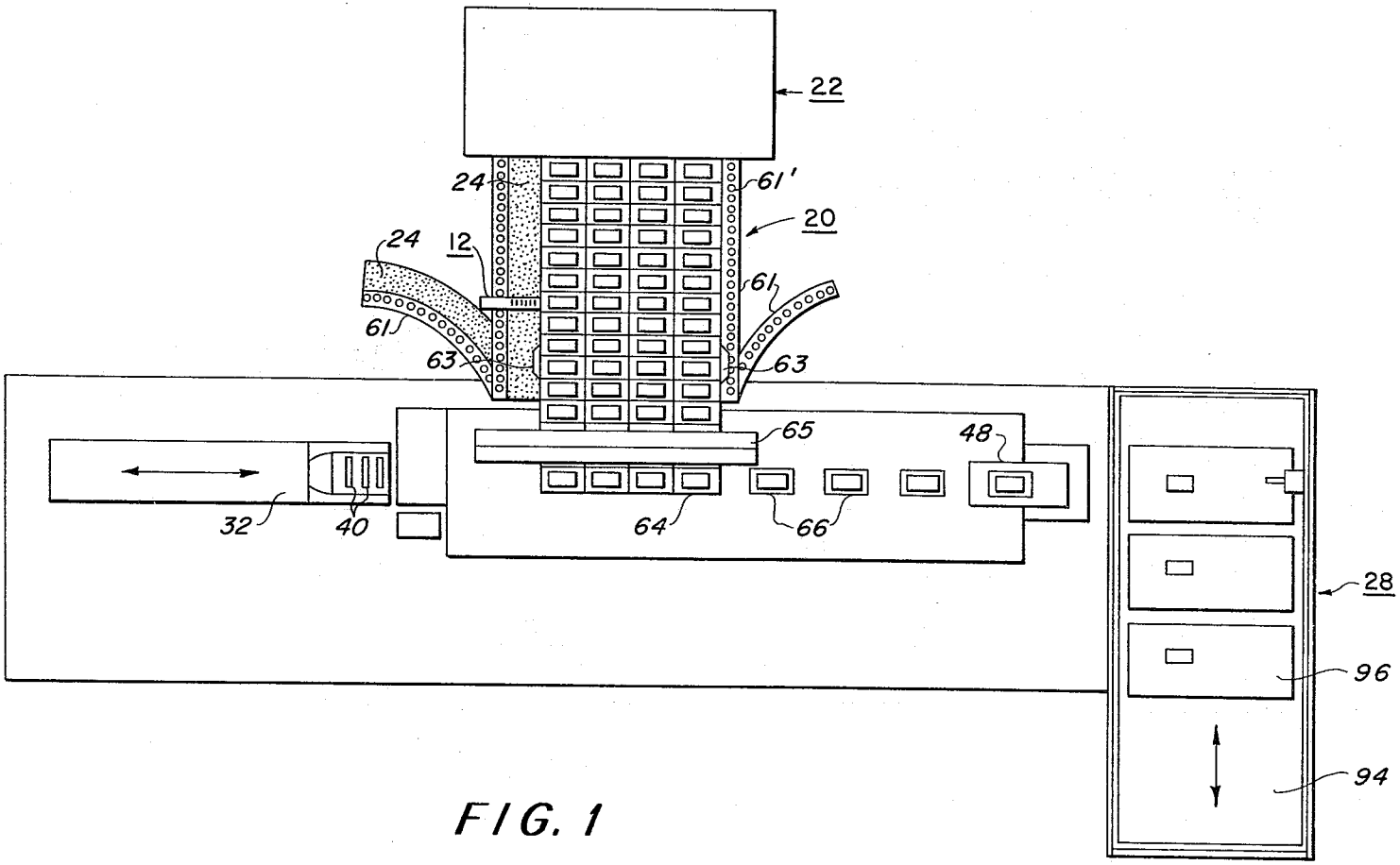
FIG. 1 is a plan view of an exemplary automatic article labeling machine with which the present invention finds ready application.

Referring now to the drawings, and in particular to FIG. 1, there is illustrated an exemplary embodiment of automatic article labeling apparatus comprising article conveying mechanism 32, label cutting means 65, transfer means 48 and labeled article conveying means 28. Article conveying mechanism 32 is adapted to transport an article from a suitable supply therefor, not shown, to the label applying station at which transfer means 48 is disposed. The article conveying mechanism may comprise a conventional conveyor device or a reciprocating shuttle mechanism capable of supplying the label applying station with an article during a forward stroke thereof and to return to the article supply during a return stroke thereof. Vacuum hold down ports 40 may be provided adjacent the article conveying mechanism to assist in the transfer of articles from the article supply to the label applying station. Conventional endless belts and drive rollers, not shown, may additionally be provided to efficiently transport each article to be labeled to the label applying station.

An array of printed labels 20 is provided comprising a label field including a plurality of rows and at least one column of printed labels, and a label identifying field 24. As will be described in more detail hereinbelow, the label identifying field 24 includes indicia associated with corresponding rows of labels to thereby identify the information borne by a predetermined label in an associated row. The array of printed labels further includes opposite side margins 61 having perforations 61' adapted for engagement with sprockets, not shown, whereby the array of printed labels may be advanced to the label applying station. Rotary knives 63 are provided to sever label identifying field 24 and side margins 61 from the array of printed labels prior to the advancement of said array to the label applying station. Label cutting means 65, which may comprise a conventional guillotine or similar device, is adapted to derive rows of labels 64 from the array of printed labels advanced thereto. As is apparent from FIG. 1, label cutting means 65 is capable of deriving the rows of labels 64 from the array of printed labels subsequent to the severing of label identifying field 24 and side margins 61 therefrom. Additional cutting devices, not shown, such as conventional roller cutters, are provided to further divide each row of labels into individual labels 66. A conventional transport mechanism, not shown in detail, serves to carry the individual labels 66 to the transfer means 48 disposed at the label applying station.

The array of printed labels may be produced by any conventional printing mechanism. However, said array is preferably printed by a conventional printing mechanism controlled by an electronic digital computer. Thus, the array including the label identifying field 24 and side margins 61 may be recognized as a conventional print-out normally produced by such computer regulated printing mechanism. In an exemplary application of the present invention wherein printed labels are affixed to articles adapted to be mailed to addressed recipients (or, alternatively, wherein the information borne by labels is transferred to such articles) it is appreciated that the electronic digital computer may be advantageously employed to compile revise and store appropriate mailing lists. As will be further described hereinbelow, the electronic digital computer may be additionally programmed in a conventional manner to provide the indicia disposed in label identifying field 24.

As the array of printed labels is advanced to the label cutting means 65 and thence to the label applying station, the label identifying field 24 traverses a fixed scanning means 12. The scanning means is adapted to sense the indicia provided in the label identifying field 24 and to generate representations thereof for a purpose soon to be described. It may be appreciated that the indicia is provided in the label identifying field by the computer controlled mechanism 22. If said indicia comprises optical sense marks, scanning means 12 may comprise conventional optical scanning devices, such as photoelectric scanning means. Alternatively, if the indicia is provided with electrically conductive or magnetic ink, for example, scanning means 12 may comprise conventional sensing means compatible therewith. As a further alternative, if the indicia is provided in conventional punch coded form, scanning means 12 may comprise conventional optical sensing means, as aforementioned, or other conventional punch coded sensing means, such as sensing fingers, or the like.

Transfer means 48 may comprise a rotatable transfer wheel adapted to receive successive ones of the individual labels 66 and to rotate each received label into a transfer relationship with an article conveyed to the label applying station. If each label includes a thermally activatable adhesive coating thereon, the transfer means 48 may include conventional heating means to expedite the transfer of such label to an associated article. Alternatively, if each label includes a pressure sensitive adhesive thereon, the transfer means 48 is capable of applying suitable pressure to the label as said label is transferred to an article. Alternatively, each label 66 may merely be provided with a conventional, transferable image thereon such that the label itself is not affixed to an article but the information thereon is, nevertheless, appropriately transferred. For example, each label may include a wax impression thereon, adapted to be transferred to a receiving surface under the influence of heat and pressure. As a further example, a powder image may be provided on a label, said powder image being capable of transfer to a surface and to be fixed thereto. The used labels may then be collected and stored for reuse, or may be discarded.

Labeled article conveying means 28 is provided to receive successively labeled articles from the label applying station and to convey such labeled articles to further apparatus, not shown. The labeled article conveying means may comprise a conventional article stacker having one or more conveyor belt devices 94 whereby labeled articles drop downwardly onto such conveyor belts from the label applying station to thus form stacks of labeled articles 96. Such stacks may thus facilitate a subsequent mailing or distributing operation. As will soon be described, the height of each stack may be dependent upon preselected information borne by a predetermined label. If desired, label article conveying means 28 may merely comprise a conveyor belt device 94 that is continuously operable to receive successive ones of the labeled articles and to convey such labeled articles to further means without requiring a stacking operation.

The operation of the automatic article labeling apparatus illustrated in FIG. 1, which may be substantially similar to the article labeling apparatus described in aforementioned U.S. Pat. No. 3,641,319, will now be briefly described. To facilitate the following explanation, it will be assumed that the illustrated apparatus is employed to transfer printed address labels to articles such as magazines, envelopes, or other suitable mailing pieces and that a predetermined operation of such apparatus is initiated when a predetermined label included in a particular classification is transferred to an associated article. It is, of course, clearly recognized that the illustrated apparatus may be adapted for transfer of the information borne by the address labels, each label need not be physically affixed to an article.

Successive articles are conveyed from the article supply, not shown, to the label applying station by article conveying mechanism 32. Concurrent with the conveying of articles, the array of printed labels is advanced to label cutting means 65 and thence to transfer means 48 disposed at the label applying station. The array of printed labels may be previously printed and stored or, alternatively, may be simultaneously printed by the computer controlled mechanism 22. In either event, the label identifying field 24 together with side margins 61 are deleted from the label field by cutting knives 63 as the array of labels is advanced. Successive rows of labels 64 are derived from the array of printed labels by label cutting means 65. Further, individual labels 66 are derived and advanced toward the label applying station. The arrival of a label 66 at the transfer station coincides with the arrival of an associated article thereat. Accordingly, transfer means 48 serves to transfer the arrived label 66 to the associated article and the thus labeled article is then transported to the labeled article conveying means 28. The foregoing operation is continuously and successively repeated until a predetermined label bearing preselected information is transferred to an article.

As the array of printed labels advances toward the label applying station, the label identifying field 24 is scanned by scanning means 12 whereat the indicia disposed in the label identifying field is sensed. As will be described in more detail with respect to FIG. 2, the indicia disposed in the label identifying field 24 is associated with corresponding rows of labels. Moreover, the indicia serves to identify the information borne by a predetermined label in an associated row. For example, if the automatic article labeling apparatus illustrated and described herein is utilized in an article mailing operation, the array of printed labels may be conveniently grouped in accordance with post office zip code numbers. The indicia indicated in label identifying field 24 may, therefore, identify the post office zip code number borne by each label in an associated row of labels. If one row of labels includes two post office code numbers, for example, the indicia associated with that one row may further identify the position of the last label bearing a first post office zip code number or the position of the first label bearing a second post office zip code number. As an alternative example, if a label in a given row of labels bears the address of a subscribing recipient whose subscription is soon to expire, the indicia associated with that given row may identify the expiration date of such subscription and additionally locate the position of that label in said given row. In accordance with a still further example, if a given row of labels includes one label addressed to, for instance, a doctor, the indicia associated with that given row may represent that a label is addressed to a doctor and may further locate the position of that particularly addressed label in said given row. it should be clearly recognized that the foregoing examples of indicia serving to identify the information borne by labels in associated rows are not mutually exclusive. Thus, the indicia associated with a first row may represent the post office zip code number borne by a label in that first row whereas the indicia associated with a second row may represent a subscription expiration data borne by a label in that second row and indicia associated with a third row may represent the address of a doctor borne by a label in that third row.

As the aforementioned indicia is sensed by scanning means 12, electrical representations of the sensed indicia are generated and applied to comparing means described hereinbelow with respect to FIG. 2. As will soon be appreciated, the comparing means may be selectively operable by an operator to determine if the information borne by a predetermined label and identified by the indicia scanned by scanning means 12 corresponds to preselected information. For example, if an operator wishes to select the last (or first) label included in a predetermined zip code group, the indicia sensed by scanning means 12 and applied to the comparing means will have no operable effect until the predetermined zip code number is sensed. When the last (or first) label included in that predetermined zip code group, as determined by the sensed indicia, is applied to an associated article, a predetermined machine operation is initiated. For example, if that article labeled with the last (or first) label included in the zip code group is to be marked, a suitable marking operation may now be performed. Alternatively, if the article labeled with the last (or first) label included in the zip code group is to be separated from subsequently labeled articles, a suitable delay in the succeeding labeling operation may be initiated. As a further example, if that article labeled with the last (or first) label included in the zip code group is to be skewed, or displaced, on conveyer belt 94, for example, such skewing operation may now be performed.

Similar to the just-described operation in response to the sensing of the predetermined zip code numbers, if a machine operation is to be performed whenever a label addressed to a subscribing recipient whose subscription is about to expire is affixed to an article, it may be appreciated that the aforementioned comparing means may be operable to respond to sensed indicia representing an expiration date. It is expected that at least some of the rows of labels will be associated with indicia representing post office zip code numbers included in the addresses borne by said labels. However, a row of labels including one label addressed to a subscribing recipient whose subscription is about to expire may be associated with indicia representing the subscription expiration date. The zip code number identifying indicia sensed by scanning means 12 will now have no effect upon the comparing means which is now operable to determine if the sensed indicia represents a preselected expiration date. Once it has been determined that a row of printed labels associated with the sensed indicia includes a label addressed to a subscribing recipient whose subscription is to expire on the predetermined expiration date, the automatic article labeling apparatus is conditioned to execute a predetermined operation when the identified label is transferred to an associated article.

A similar process is effected when, for example, the aforementioned comparing means is conditioned to determine if the indicia disposed in label identifying field 24 is representative of a label in an associated row of labels bearing an address directed to, for instance, a doctor. In this regard, it is recognized that scanned indicia identifying zip code numbers and subscription expiration dates have no effect upon the comparing means. However, when indicia representing a label addressed to a doctor is sensed by scanning means 12, the comparing means then determines that a row of labels associated with the sensed indicia includes a label bearing information corresponding to preselected information, viz., the address of a doctor.

In general, it is preferable that the predetermined operation to be performed by the automatic labeling apparatus when a label bearing preselected information is sensed be executed subsequent to the transfer of said label to an associated article. As may be recognized from FIG. 1, an interval of delay must be provided from the time the sensing operation is performed to the time the identified label is transferred to an article. This interval of delay must include the time required for the row in which the identified label is disposed to advance from the scanning means to the label cutting means 65. Additionally, the interval of delay must also include the time required for the row of labels 64 to be divided into individual labels 66 and for the identified label included in said individual labels 66 to be advanced to the transfer means 48 disposed at the label applying station. Finally, the time required for the transfer means 48 to transfer said identified label to an associated article and the additional time required for the labeled article to be transported to the labeled article conveying means 28 must also be included in the interval of delay. At the conclusion of this interval of delay, that is, when the article labeled with the identified label is transported to the labeled article conveying means 28, the predetermined operation of the article labeling apparatus may be performed. In accordance with the exemplary operations noted hereinabove, appropriate separation between the article labeled with the identified label and the succeeding articles may be effected by providing a temporary interruption in the operation of the automatic article labeling apparatus sufficient to convey the labeled article a predetermined distance by conveying belt 94. As an alternative operation, the article labeled with the identified label may be appropriately marked once said article is transported to labeled article conveying means 28. As a further alternative operation, the labeled article may be appropriately skewed upon being transported to the labeled article conveying means. It is apparent that, in each of the aforenoted examples, the particular operation is effected upon the conclusion of the aforedescribed interval of delay. As is readily understood, the total interval of delay is dependent upon the particular position of the identified label in the associated row of labels. More particularly, if the identified label is, for instance, the fourth label in the row of labels, it may be appreciated that the time required for said identified label to be advanced from label cutting means 65 to transfer means 48 is significantly greater than, for instance, the time required for the first label in said row of labels to be transferred from the label cutting means to the transfer means.

Label Form

Figure 2:
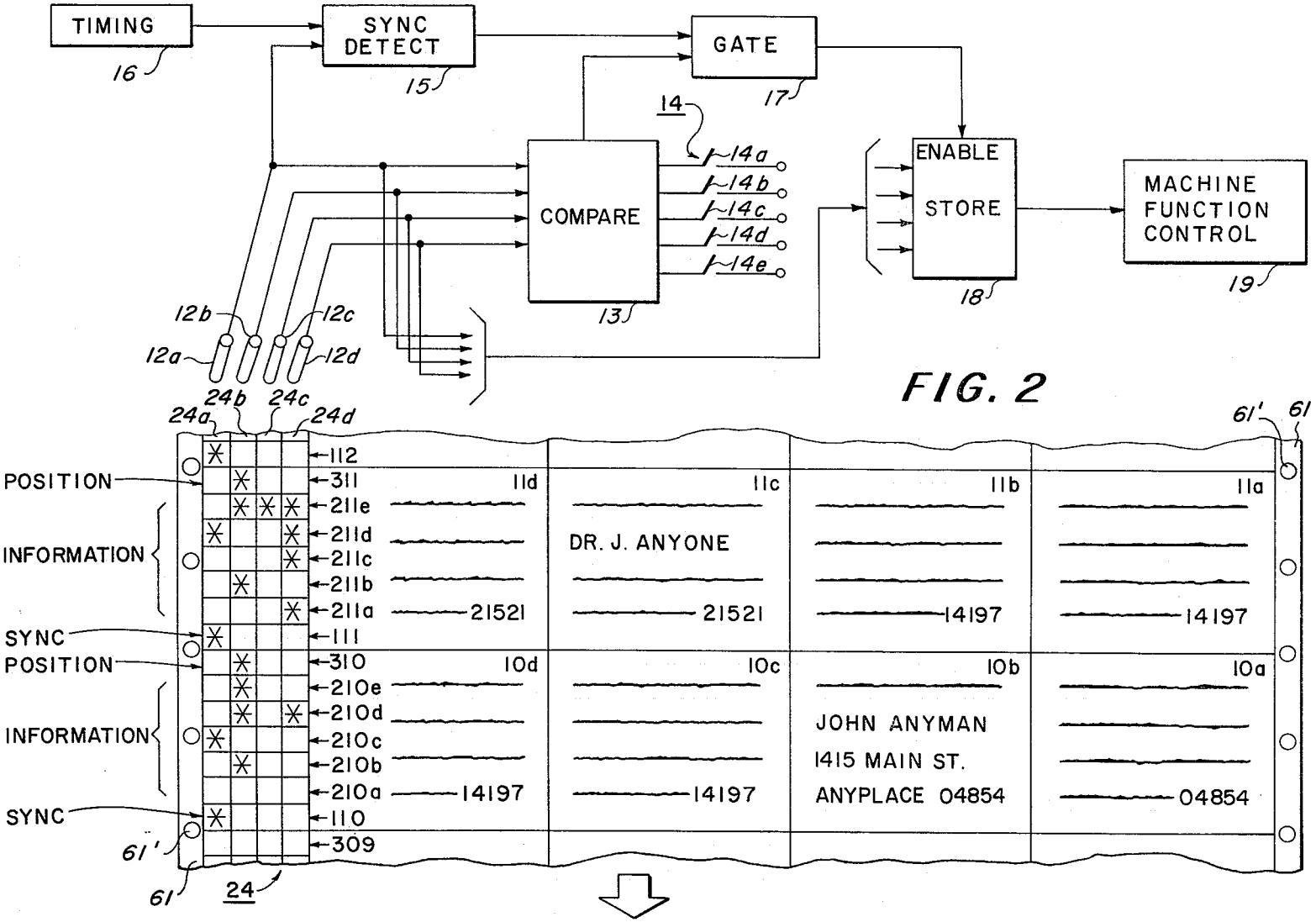
FIG. 2 is a partial illustration of the array of printed labels utilized by the automatic article labeling apparatus of FIG. 1, and further includes a block diagram of control apparatus that is operable with a portion of the illustrated array.

An exemplary embodiment of apparatus that may be advantageously employed with the array of printed labels described with respect to FIG. 1 is illustrated in the block diagram of FIG. 2. Also illustrated is an enlarged view of a preferred array of printed labels including the label field and the label identifying field. In accordance with the preferred array, the label field includes a plurality of rows of labels 10, 11 . . ., and at least one column of labels. As is understood, the label field is printed by, for example, a computer controlled printing mechanism 22. The illustrative example depicted in FIG. 2 represents that the label field includes four columns of labels. However, it should be clearly recognized that any suitable number of columns of labels may be included in the label field. Thus, it is apparent that the instant invention finds ready application in bulk mailing techniques wherein each label bears information regarding the name of an addressed recipient, the street address, town and state of the named recipient and the post office zip code number of the named recipient's address. In addition, each label may further include information denoting, for example, professional characteristics of the named recipient, e.g., doctor, lawyer, or the like. Furthermore, if the bulk mailing process with which the instant invention finds application is employed in conjunction with the distribution of subscribed material, each label may also include information designating, for example, the expiration date of the subscription of each named recipient.

As illustrated, label row 10 is comprised of labels 10*a*, 10*b*, 10*c*, and 10*d*, and includes label 10*b* bearing zip code number 04854. For the purpose of explanation, it is here assumed that label 10*b* is the last label addressed to a recipient in zip code number 04854. Thus, the next succeeding label, label 10*c*, is addressed to a recipient in, for example, zip code number 14197. The last label addressed to zip code number 14197 may, for example, be disposed in label row 11, such as label 11*b*. Accordingly, the next succeeding label, label 11*c*, may be addressed to a different zip code number, such as zip code number 21521.

Label identifying field 24 is disposed in a discardable column of the preferred array of labels and is comprised of a plurality of groups of indicia. Each group of indicia is associated with at least one row of labels. As has been described, the indicia is comprised of sense marks which may be produced by the computer controlled printing mechanism 22, or the like. The sense marks are in coded form and include a first coded portion to identify the information borne by at least one of the printed labels in an associated label row and a second portion to identify the particular column in which a predetermined one of the labels is positioned. More particularly, the sense marks associated with label row 10 are divided into rows 210*a*, 210*b*, 210*c*, 210*d* and 210*e*, designated the information identifying rows. Each row 210*a* . . . 210*e* here includes coded sense marks to identify for the present example, a particular digit of the zip code number borne by at least one of the labels in label row 10. A further row of coded sense marks, row 310, designated the position identifying row, identifies the particular location of a predetermined one of the labels in label row 10. Hence, rows 210*a* . . . 210*e* of coded sense marks, together with row 310, identify label 10*b* as the last label included in the zip code group 04854. Although any conventional coding scheme may be employed herewith, the coded sense marks included in rows 210*a* . . . 210*e* are configured in binary coded decimal (BCD) form. Thus, each row of coded sense marks is further divided into a plurality of columns 24*a*, 24*b*, 24*c* and 24*d*. The selective positions of coded sense marks in row 210*a* identifies the digit 0 included in the zip code number borne by label 10*b*. Hence, no sense mark is provided in row 210*a*. Similarly, a sense mark is provided in column 24*b* of row 210*b* to thus identify, in BCD form, the digit 4 included in the zip code number of label 10*b*. Also, a sense mark is positioned in column 24*a* of row 210*c* to represent the digit 8. Furthermore, sense marks are positioned in columns 24*b* and 24*d*, respectively, of row 210*d* to represent, in BCD form, the digit 5. Finally, a sense mark is positioned in column 24*b* of row 210*e* to identify the digit 4. Thus, it is recognized that each row 210*a* . . . 210*e* identifies, in BCD form, a discrete portion of the zip code number information borne by label 10*b*. Of course, since label 10*b* has been assumed to be the last label included in the zip code group 04854, it is apparent that the sense marks positioned in rows 210*a* . . . 210*e* also identify the zip code number borne by label 10*a*. In accordance with the present example, the predetermined label included in zip code group 04854 that is of particular interest is the last label included in such group. Row 310 includes a sense mark disposed in column 24*b* representing that the second label in label row 10, i.e. label 10*b*, is the last label included in zip code 04854. As may be appreciated, since the number of labels included in label row 10 is here equal to the number of columns included in label identifying field 24, the particular location of the predetermined label included in label row 10 may be represented by a sense mark disposed in a corresponding column of field 24. Nevertheless, it is contemplated that, if desired, row 310 may include sense marks disposed in BCD form to identify the location of the predetermined label. Thus, row 310 may include a sense mark in column 24*c* (the next least significant digit) to represent, in BCD form, label 10*b*. It is seen that the coded sense marks included in rows 210*a* . . . 210*e* and 310 identify not only the location of a predetermined label but also the particular information borne by said predetermined label.

As illustrated, the group of sense marks associated with row 10 includes a further row 110, designated the sync code row, providing a synchronizing code for a purpose soon to be described. Although any convenient synchronizing code may be employed, in the interest of simplification a sense mark positioned at column 24*a* of row 110 is here adopted.

The aforedescribed sense marks serving to identify the information borne by at least one label in a row of labels, for example, the sense marks as shown in rows 210*a* . . . 210*e*, need not be provided for each label row in the array of labels. More particularly, if each label in label row 9, not shown, bears zip code number 04854, it is not necessary to provide coded sense marks aligned with label row 9, similar to the sense marks shown in rows 210*a* . . . 210*e*, to identify such zip code number. Nevertheless, if desired, such sense marks may be provided. It is, of course, clearly recognized that, since label row 9 does not include the last label in zip code group 04854, the row of sense marks serving to identify the location of such last label, such as the sense marks shown in row 310, will not be provided. Hence, row 309, aligned with label row 9, is here devoid of sense marks. Thus, the sense marks identifying zip code number 04854 in coded form may be provided in alignment only with that row of labels within which a predetermined label, e.g., the last label included in zip code group 04854, is located. If further desired, such sense marks may additionally or, alternatively, be provided in alignment with the row of labels wherein the first label bearing zip code number 04854 appears. In this regard, the sense mark provided, for example, in row 310 in label identifying field 24 may represent the location of the first label bearing such zip code number should it be desired to ascertain the location of such label.

It is seen that in the illustrative example label 10*c* is the first label bearing zip code number 14197. If the last label included in zip code group 14197 is, for example, label 11b, it may be appreciated that the group of sense marks aligned with label row 11 may identify label 11*b* as being such last label. Thus, row 111, designated the sync code row, includes a sense mark at column 24*a* thus forming the aforementioned synchronizing code. Rows 211*a* . . . 211*e*, designated the information identifying rows, represent in BCD form, the zip code number 14197. Row 311, designated the position identifying row, includes a sense mark at column 24*b* representing that the last label included in the zip code group identified by the sense marks disposed in rows 211*a* . . . 211*e* is located at label 11*b*.

As described hereinabove, the sense marks provided in label identifying field 24 may, if desired, serve to identify other pertinent information borne by at least one label included in a group of labels. For example, if the sense marks aligned with label row 10 are assumed to identify a particular post office zip code number as well as the last label included in that zip code group, the sense marks aligned with label row 11 may, as a further example, identify a label addressed to a doctor. Sense marks disposed in row 311 will, of course, identify the predetermined label included in label row 11 that bears the information identified by the sense marks disposed in rows 211*a* . . . 210*e*. Thus, if the label located at label 11*c*, for example, is addressed to a doctor, it is appreciated that rows 211*a* . . . 211*e* will represent, in coded form, that at least one label positioned in label row 11 is so addressed. A sense mark positioned at column 24*c* in row 311 will represent that label 11*c* is the predetermined label included in label row 11 that is addressed to a doctor.

It is now readily apparent that the improved label form of the present invention admits of wide flexibility not heretofore obtainable. More particularly, the label identifying field 24, comprised of groups of sense marks disposed in a discardable column of the array of printed labels is capable of identifying diverse information borne by various labels in associated label rows to permit an operator to selectively control predetermined machine operations in accordance with the detection of selected information bearing labels. Hence, a predetermined machine operation may be executed upon detecting the last (or first) label included in a predetermined zip code group, for example. Similarly, a machine operation may be executed upon detecting a label addressed to a doctor, for example. By utilizing the improved label form of the present invention, the machine operation may be performed upon detecting a predetermined label bearing preselected information without requiring an alteration or revision in the computer program that regulates the computer controlled printing mechanism from which the array of printed labels are produced. A simple operator executed manual operation, such as the manual operation of a keyboard device, for example, serves to condition the automatic article labeling apparatus to detect such predetermined labels bearing preselected information.

Label Identifying Field Examining Means

Exemplary apparatus that is preferably employed with the improved label form of the present invention is illustrated in FIG. 2 and comprises scanning means 12, comparing means 13, switch means 14, gate means 17 and storage means 18. Scanning means 12 preferably comprises fixedly disposed optical sensing means well known to those of ordinary skill in the art and adapted to sense the optical sense marks disposed in label identifying field 24. Accordingly, the scanning means may comprise conventional photoelectric devices, such as photodiodes, phototransistors, phototubes or the like, in optical communication with label identifying field 24, the latter being appropriately illuminated by a suitable source of illumination, not shown. The scanning means 12 is adapted to sense an entire row of coded sense marks in parallel relation. Accordingly, a plurality of sensing means 12*a*, 12*b*, 12*c* and 12*d* are aligned with corresponding columns 24*a*–24*d*, respectively, of the label identifying field 24. Thus, as the array of printed labels is advanced to the label applying station, the label identifying field 24 passes proximate the scanning means 12 whereby successive rows of sensed marks are scanned by sensing means 12*a*–12*d*. One of ordinary skill in the art will, therefore, appreciate that the scanning operation performed by the sensing means is here equivalent to parallel by bit, serial by character; however, any other conventional scanning configuration may be employed. It is, of course, recognized that the plural sensing means 12*a*–12*d* may be replaced by a single sensing device, such as a conventional mechanical scanner, flying spot scanner, or the like, whereby a row of sense marks may be serially scanned. Furthermore, if the sense marks disposed in label identifying field 24 are comprised of, for example, electrically conductive marks, magnetic marks, or the like, it is appreciated that scanning means 12 may comprise compatible sensing devices, such as electrical conducting means, magnetic sensing means or the like.

The individual outputs of sensing means 12*a*–12*d* of scanning means 12 are coupled to comparing means 13 and, additionally, to storage means 18. Comparing means 13 may comprise a conventional digital comparing circuit having first and second sets of input terminals, and capable of determining if the signals supplied to the first set of input terminals correspond to the signals supplied to the second set of input terminals. Hence, comparing means 13 may comprise a conventional comparator which provides a comparison between two multi-bit words, such as the comparator produced by Fairchild Semiconductor Division of Mountain View, Calif., or a conventional multi-bit magnitude comparator, such as that produced by Texas Instruments Incorporated, Dallas, Tex. Alternatively, comparing means 13 may comprise a conventional digital adding circuit, adapted in the well-known manner to execute a multi-bit comparing function. The first set of input terminals of comparing means 13 is coupled to scanning means 12, as aforenoted, and the second set of input terminals of the comparing means is coupled to switch means 14. Switch means 14 is preferably capable of being manually operated to generate signals representing preselected information. Accordingly, the switch means may comprise a conventional keyboard device diagrammatically represented as individual switches 14*a*, 14*b*, 14*c*, 14*d* and 14*e*. Although only five switches are here illustrated, it should be clearly recognized that switch means 14 may comprise any conventional keyboard switching mechanism such as a conventional Teletype switching keyboard, or the like. An operator may operate selected ones of the switches included in switch means 14 to generate the appropriate signals representing the preselected information as determined by the selectively operated switches. For example, if a predetermined label, such as the last (or first) label, included in a pre-selected zip code group, such as zip code group 04854, is to be detected, an operator may selectively operate switch means 14 whereby individual switches corresponding to the numerals 0, 4, 8, 5, and 4 may be operated to supply a coded representation thereof to comparing means 13. Alternatively, if a label addressed to a doctor, for example, is to be detected, switch means 14 may be selectively operated to generate the appropriate electrical manifestations representing "doctor." As a still further example, if a label addressed to a subscribing recipient whose subscription is about to expire is to be detected, switch means 14 may be selectively operated to generate electrical signals representing subscription expiration information. Although switch means 14 has been described as, preferably, a manually operable device, it is manifest that the switch means may admit of automatic operation under the control of suitable processing means to supply comparing means 13 with electrical signals representative of preselected information.

The output terminal of comparing means 13 is coupled via gate means 17 to an enable input terminal of storage means 18. Gate means 17, which may comprise a conventional logic gating circuit such as an AND gate, or the like, is provided to assure the synchronous operation of storage means 18 as the array of printed labels is advanced to the label applying station. Hence, gate means 17 includes a first input terminal coupled to comparing means 13 and a second input terminal coupled to synchronizing code detecting means 15. Synchronizing code detecting means 15 may comprise a conventional gating circuit adapted to detect the synchronizing codes disposed in label identifying field 24. Hence, synchronizing code detecting means 15 includes input terminals coupled to scanning means 12 and a further input terminal coupled to timing means 16. As the synchronizing code disposed in label identifying field 24 has here been assumed to comprise a sense mark disposed at column 24*a* in the first row of sense marks associated with a row of labels (e.g., row 110, 111, . . . ), synchronizing code detecting means 15 is here coupled to sensing means 12*a*. However, it is recognized that the synchronizing code detecting means may include plural input terminals coupled to selected ones of the sensing means 12*a*–12*d* in accordance with the particular synchronizing code employed. Timing means 16 coupled to synchronizing code detecting means 15 is adapted to generate periodic timing signals synchronized with the advance of the array of printed labels to the label applying station. The timing means may, therefore, comprise a conventional clock circuit whereby a clock pulse of predetermined duration is applied to synchronizing code detecting means 15 coincidental with the scanning of the synchronizing code included in label identifying field 24 by scanning means 12, i.e., coincidental with the scanning of rows 110, 111, . . . . As such timing means is conventional, further description thereof may be omitted in the interest of brevity.

Storage means 18 may comprise a conventional storing circuit having plural input terminals coupled to scanning means 12 and adapted to store the signals applied to said plural input terminals for a variably determined interval of time upon receiving a signal applied to the enable input terminal thereof. Hence, storage means 18 may comprise a conventional multistage shift register having plural input stages coupled to corresponding ones of sensing means 12*a*–12*d* via, for example, conventional gating circuits having a common gating input terminal coupled to gate means 17. The multi-stage shift register may further include a timing input coupled to a clock circuit, such as the clock circuit that might be included in timing means 16, to synchronously advance signals therethrough as the array of printed labels is advanced to the label applying station. When a signal shifted through the multi-stage shift register is shifted into a predetermined storage stage, as output signal is produced by storage means 18. As will soon become apparent, the delay incurred in producing the output signal is a function of the particular input stage to which an input signal is applied by the scanning means 12. This output signal may be designated an operation initiating signal whereby the predetermined machine operation is executed in response thereto. Accordingly, machine function control means 19 is coupled to storage means 18 and may include conventional machine controlling apparatus responsive to the operation initiating signals applied thereto by storage means 18 to thereby initiate the predetermined machine operation. Hence, machine function control means 19 may include conventional switches, clutch mechanisms, driving means and the like capable of activating a predetermined machine delay, an article skewing operation, an article marking operation or other predetermined machine operation.

Storage means 18 may alternatively comprise other conventional apparatus capable of generating an operation initiating signal at the conclusion of a variably determined interval of time that is dependent upon the particular input terminal at which an input signal is received. Nevertheless, a first time delay may obtain when, for example, a signal generated by sensing means 12*a* is applied to a corresponding input terminal of storage means 18. A second time delay may obtain when a signal generated by sensing means 12*b* is applied to a corresponding input terminal of storage means 18. Similarly, third and fourth delays may obtain when signals generated by sensing means 12*c* and 12*d*, respectively, are applied to corresponding input terminals of storage means 18. The purpose of the delay in generating the operation initiating signal by storage means 18 will soon become apparent.

The manner in which the apparatus illustrated in FIG. 2 operates in cooperation with the improved label form will now be described. For the purpose of explanation, it will be assumed that a predetermined machine operation is to be performed when, for example, the last label included in a particular zip code group is applied to an article. Thus, the zip code information borne by each printed label is here of interest. It will be further assumed that the particular zip code of interest is zip code number 04854. Accordingly, switch means 14 may be operated to generate electrical signals representing, in coded form, the zip code number 04854. The second set of input terminals of comparing means 13 is thus supplied with suitable signals representing preselected information borne by at least one label included in the array of printed labels.

As the array of printed labels is advanced to the label applying station, the sense marks included in label identifying field 24 thereof are successively scanned by scanning means 12. The individual sensing means 12*a*–12*d* generage representations of the scanned sense marks. These electrical representations are simultaneously applied to comparing means 13 and to storage means 18. Additionally, these electrical representations are further applied to synchronizing code detecting means 15. Timing pulses generated by timing means 16 and synchronized with the advance of the array of printed labels are concurrently applied to synchronizing code detecting means 15. It is, therefore, recognized that synchronizing code detecting means 15 produces an output signal only upon the simultaneous occurrence of a predetermined synchronizing code and a timing pulse. The synchronizing code may be provided in alignment with each row of printed labels or, alternatively, in alignment with selected rows of printed labels. In either embodiment, the synchronizing code is preferably included in the group of sense marks that are provided to identify the information borne by a predetermined label in a given row. As is appreciated, when electrical representations of the synchronizing code are generated in coincidence with a synchronized timing pulse, synchronizing code detecting means 15 applies a signal to gate means 17.

As successive sense marks are scanned by scanning means 12, the electrical representations thereof are applied to comparing means 13 and to storage means 18. Since comparing means 13 has been assumed to be predisposed to determine when labels bearing zip code number 04854 are advanced, it is appreciated that an output signal is not generated by the comparing means until the preselected information is scanned. Additionally, the electrical representations applied to storage means 18 by scanning means 12 are not stored therein, or otherwise employed to activate the storage means, until an appropriate enable signal is received thereby from gate means 17.

When label row 10 is advanced to scanning means 12, the synchronizing code provided in row 110 in label identifying field 24 is sensed by the scanning means. More particularly, in accordance with the example assumed herein, sensing means 12*a* senses the sense mark positioned in column 24*a* of row 110 to supply an electrical representation thereof to synchronizing code detecting means 15. If a timing pulse is applied to the synchronizing code detecting means by timing means 16 in substantial coincidence with the scanning of row 110, an output signal is generated by the synchronizing code detecting means to thereby activate gate means 17. As the succeeding rows 210*a* . . . 210*e* are scanned by scanning means 12, electrical representations of the coded sense marks are supplied to comparing means 13. More particularly, as row 210*a* is scanned, electrical representations of numeral 0 are generated and applied to the comparing means. As row 210*b* is scanned, electrical representations of the numeral 4 are generated and applied to comparing means 13. Similarly, as rows 210*c*, 210*d* and 210*e* are scanned, successive electrical representations of numerals 8, 5 and 4 are generated and applied to comparing means 13. Thus, it is seen that as row 210*e* is scanned, the cumulative representations supplied to comparing means 13 corresponds to the preselected information previously supplied to the second set of input terminals by switch means 14. The comparing means is now activated to determine that the information borne by at least one of the labels in label row 10 and identified by the coded sense marks positioned in rows 210*a* . . . 210*e* corresponds to preselected information. An output signal is thus produced by comparing means 13 and applied to gate means 17.

As gate means 17 has been activated by the signal applied thereto by synchronizing code detecting means 15, the application thereto of an output signal by comparing means 13 is sufficient to generate an enable signal. The enable signal is supplied to the enabling input terminal of storage means 18. It is appreciated that as the enable signal is applied to storage means 18, sense mark row 310 is advanced to scanning means 12. The sense marks disposed in row 310 are scanned by scanning means 12 and electrical representations thereof are generated and supplied to storage means 18. The enable signal supplied to the enable input terminal of storage means 18 permits the storage means to store, or otherwise respond to, the electrical representations now applied thereto by the scanning means.

In the example represented by FIG. 2, the sense mark positioned at column 24*b* of row 310 actuates sensing means 12*b* to generate an appropriate electrical representation thereof and to supply said electrical representation to a corresponding input terminal of storage means 18. If storage means 18 comprises a multi-stage shift register having, for example, four input stages, the electrical representation generated by sensing means 12b is here applied to the second input stage. Synchronized timing pulses, not shown, are applied to storage means 18 and serve to advance the electrical representation from the second input stage of storage means 18 toward a predetermined storage stage therein. The timing pulses are synchronized with the movement of the array of printed labels such that the stored electrical representation is advanced in timed relationship to the advance of the array to label cutting means 65 illustrated in FIG. 1. As label row 10 is severed from the label array and further divided into individual labels 66, the stored electrical representation is further advanced in synchronism with the movement of the individual labels 66 to the label applying station. When label 10*b* (or the transferable information thereon) is transferred by transfer means 48 to an article, and as the labeled article is transported to labeled article conveying means 28, the electrical representation is advanced into the predetermined storage stage in storage means 18. Consequently, it is apparent that the interval of time required to shift the electrical representation from the second input stage of storage means 18 to the predetermined storage stage therein is substantially identical to the total time required to advance label row 10 from alignment with scanning means 12 to label cutting means 65, to further advance label 10b from label cutting means 65 to transfer means 48, to then transfer label 10*b* to an article and to subsequently transport the labeled article to labeled article conveying means 28. Storage means 18 now generates the operation initiating signal to thereby initiate the predetermined operation of the automatic article labeling apparatus. It should be clearly understood that if the sense mark provided in row 310 was, for example, disposed in column 24*a*, the application of an electrical representation to storage means 18 by sensing means 12*a* would result in the generation of the operation initiating signal once label 10*a* is transferred to an article and the labeled article is subsequently transported to labeled article conveying means 28. This, of course, obtains because the electrical representation generated by sensing means 12*a* is now applied to the first input stage included in storage means 18, thereby decreasing the interval of time required to advance said electrical representation into the predetermined storage stage. Similarly, if the sense mark provided in row 310 was disposed in column 24*d*, for example, sensing means 12*d* would generate an electrical representation thereof and supply said electrical representation to a corresponding input terminal of storage means 18. The storage means would now generate the operation initiating signal once label 10*d* is transferred to an article and the labeled article is subsequently transported to the labeled article conveying means 28. It is seen that, in this latter example, the interval of time required to shift the electrical representation into the predetermined storage stage is now increased.

As label row 11 is now advanced into alignment with scanning means 12, the sense mark positioned at column 24*a* of row 111 is sensed by sensing means 12*a* and an electrical representation thereof is supplied to synchronizing code detecting means 15. If the advance of the array of printed labels maintains its pre-established synchronous relation, a timing pulse is concurrently applied to synchronizing code detecting means 15 by timing means 16. Consequently, gate means 17 is activated by the output signal applied thereto by the synchronizing code detecting means. Rows 211*a* . . . 211*e* of label identifying field 24 are now successively scanned by scanning means 12. It is appreciated that rows 211*a* . . . 211*e* identify zip code number 14197 borne by at least one of the printed labels in label row 11. Since the information represented by the sense marks in rows 211*a* . . . 211*e* does not correspond to the preselected information previously supplied to the second set of input terminals by switch means 14, viz., signals representing zip code number 04854, it is understood that comparing means 13 does not produce an output signal when row 211*e* is scanned. Thus, gate means 17 does not apply an enable signal to storage means 18 and the sense mark positioned in row 311 is not stored in storage means 18. The operation initiating signal is, therefore, not produced.

However, if switch means 14 had been operated to apply signals to the second set of input terminals of comparing means 13 to represent the information borne by at least one of the printed labels included in label row 11, such as zip code number 14197, it is appreciated that comparing means 13 would now determine that the successive sense marks in rows 211*a* . . . 211*e*, scanned by scanning means 12, represent zip code number 14197. Consequently, upon the scanning of row 211*e*, the cumulative representations supplied to the first set of input terminals of comparing means 13 is in correspondence with the preselected information represented by the switch means 14 such that the comparing means produces an output signal that is applied to gate means 17. As gate means 17 has been previously activated, an enable signal is supplied thereby to storage means 18. The application of an enable signal to storage means 18 permits the electrical representation generated by scanning means 12 in response to the scanning of row 311 to be stored in the storage means. As illustrated, the electrical representation generated by sensing means 12*b* in response to the scanning of the sense mark positioned in column 24*b* of row 311 is here applied to a corresponding input terminal of storage means 18 and is thus stored in the second input stage therein. Consequently, an operation initiating signal is produced by storage means 18 once label 11*b* (or the transferable information thereon) is transferred by transfer means 48 to an article and the labeled article is subsequently transported to labeled article conveying means 28.

Although the foregoing description has assumed that the information borne by at least one label in label row 10 and by at least one label in label row 11 and identified by the sense marks in rows 210*a* . . . 210*e* and the sense marks in rows 211*a* . . . 211*e* respectively, is zip code number information, it is manifest that the information borne by the printed labels and identified by the sense marks in label identifying field 24 may be any other information, such as a particular characteristic of an addressed recipient (e.g., a doctor or the like) or the date of expiration of a subscription, or any other desired categorization. As the sense marks disposed in rows 210*a* . . . 210*e* and rows 211*a* . . . 211*e* are scanned by scanning means 12, comparing means 13 determines if the identified information corresponds to the preselected information as represented by the operation of switch means 14. Thus, the illustrated apparatus operates in the aforedescribed manner notwithstanding the particular information borne by the printed labels and identified by the sense marks disposed in label identifying field 24, or the particular information preselected by switch means 14.

As aforedescribed, scanning means 12 preferably scans the sense marks provided in label identifying field 24 parallel by bit and serial by character. Nevertheless, any other conventional scanning configuration may be employed to supply comparing means 13 with electrical representations of the information borne by at least one label included in a row of labels. Furthermore, the foregoing description has assumed that the array of printed labels is advanced past scanning means 12 such that rows 110, 210, 310 . . . are consecutively scanned. In this manner, synchronizing indicia, label information identifying indicia and label position indicia are successively scanned. However, if desired, the synchronizing indicia may be provided in the last row of sense marks associated with a given row of printed labels. Similarly, the label position indicia may precede the label information identifying indicia. Thus, in the illustrated example, rows 110 and 310, for example, may be interchanged. Furthermore, although the array of printed labels has been assumed to be advanced in a manner such that row 10 precedes row 11 and so on, it is recognized that, alternatively, the array of labels may be advanced such that row 11 precedes row 10, and so on.

In the illustrative example of FIG. 2, it should be noted that the sense marks serving to identify the information borne by at least one label in a row of labels need not necessarily be aligned with that one row. More particularly, if label row 7 (not shown) for example, includes the first label included in zip code group 04854 and each label in label rows 8 and 9 are included in that zip code group, then the sense marks here illustrated in rows 110, 210*a*, 210*b*, 210*c*, 210*d* and 210*e* may be aligned with label row 7. In this alternative embodiment, when the sense marks aligned with label row 7 are scanned by scanning means 12, electrical representations corresponding to zip code number 04854 are generated and comparing means 13 generates an output signal as aforedescribed. Consequently an enable signal is applied to storage means 18 by gate means 17, assuming that the gate means had been previously activated. Thus, when the sense mark provided at column 24*b* of illustrated row 310 is ultimately sensed by scanning means 12, an electrical representation thereof is generated by sensing means 12*b* and applied to a corresponding input terminal of storage means 18. Accordingly, as is now understood, the operation initiating signal is generated by storage means 18 once label 10*b* (or the transferable information thereon) is transferred to an article and the labeled article is subsequently transported to the labeled article conveying means 28 notwithstanding the determination that the information borne by label 10*b* was first sensed as being borne by a label included in label row 7. Thus, the sense marks serving to identify the information borne by a group of labels may be provided in alignment with the first label in that group.

The sense marks serving to identify the particular location of a predetermined label in an identified group is preferably aligned with said predetermined label. Accordingly, plural labels included in a single group of labels may be detected and appropriate machine functions may be initiated in accordance therewith. Thus, if a label included in a particular zip code group is addressed to, for example, a doctor, appropriate sense marks may be provided in the label identifying field 24 aligned with that particular label thereby identifying that said label, although included in the zip code group, is further addressed to a doctor. Additional comparing means may then be provided to permit a machine operation to be initiated once the label addressed to the doctor is transferred to an article and the labeled article is subsequently transported to labeled article conveying means 28. It is recognized that the additional comparing means may include a first set of input terminals coupled to scanning means 12 and a second set of input terminals coupled to switch means similar to aforedescribed switch means 14. The original comparing means may serve to detect the last label included in the particular zip code group and thus permit the initiation of a machine operation when said last label in said particular zip code group is transferred to an article and the labeled article is subsequently transported to labeled article conveying means 28. Hence, the detection of plural predetermined labels included in a particular group or sub-groups may be readily facilitated in accordance with the present invention merely by providing a corresponding number of comparing means and operable switch means.

As noted hereinabove, the generation of timing pulses by timing means 16 is preferably synchronized with the advance of the array of printed labels from the computer controlled printing mechanism 22 to the label applying station. Perforations 61' in margins 61 of the array of labels are adapted for engagement with conventional sprockets, not shown, which may be driven in an intermittent manner. Alternatively, the sprockets may be driven in a continuous manner such that the array of printed labels is continuously advanced from the computer controlled printing mechanism 22 to the label applying station. In either embodiment, it is recognized that conventional driving means employed to drive these sprockets (not shown), may be utilized to generate the timing pulses applied to synchronizing code detecting means 15. As a further alternative, a suitable timing track may be provided on the label array such that the advancement of said array past a reference station serves to produce the timing pulses utilized by synchronizing code detecting means 15. Suitable sensing means aligned with said timing track may, therefore, be provided at the reference station.

While the invention has been particularly shown and described with reference to an exemplary embodiment thereof having particular application to mass distribution of literature by bulk mailing techniques, it will be obvious to those skilled in the art that various changes and modifications in form and details may be made without departing from the spirit and scope of the invention. Thus, the instant invention may be readily employed to carry out any conventional label applying operation wherein predetermined functions are to be executed in accordance with the detection of labels bearing preselected information. Although improved results are achieved in bulk mailing operations in accordance with the aforedescribed inventive concept, it is contemplated that the present invention should not be unnecessarily limited to such bulk mailing operations. Similarly, the specific predetermined operations that are to be initiated upon detecting a predetermined information bearing label are merely exemplary. It is contemplated that any desired function or operation may be performed, the particular nature thereof forming no part of the present invention per se and thus having no influence upon a ready understanding of the instant invention. Furthermore, the generation of the operation initiating signal by storage means 18 may obtain when the predetermined label bearing preselected information is advanced to any pre-established location in the automatic article labeling apparatus. It is, of course, clearly understood that the interval of delay provided by storage means 18 corresponds to the time required for said predetermined label bearing preselected information to be advanced to said pre-established location.

In addition, the various examples described hereinabove are intended merely to facilitate a ready understanding of the present invention and should not be interpreted as limiting this invention strictly thereto. Thus, the coded configuration of sense marks in the label identifying field 24 may obviously be other than the aforedescribed BCD configuration. Also, the categorization of labels with regard to the information borne thereon is not limited to zip code information, subscription information or information concerning the profession of the recipient. Clearly, other appropriate information for which identification is desired may be employed. Further, it should be noted that the block diagram of FIG. 2 is exemplary and, in the interest of simplification, various conventional components such as amplifiers and the like have been omitted therefrom.

Therefore, it is intended that the appended claims be interpreted as including the foregoing as well as all other obvious modifications and changes in form and in application.

What is claimed is:

1. For use with automatic article labeling apparatus, an array of printed labels from which individual labels are derived, said array comprising:

a label field having a plurality of rows and columns of printed labels; said label field being adapted to be separated into individual labels; and a discardable label identifying field comprised of groups of coded sense marks, each group of coded sense marks including a first portion to identify the information borne by at least one of the printed labels in at least one of said rows and a second portion to identify a predetermined one of said printed labels bearing said identified information.

2. An array of printed labels in accordance with claim 1 wherein said first portion of coded sense marks is comprised of a plurality of rows of selectively positioned sense marks, each row of selectively positioned sense marks identifying a discrete portion of said information borne by said at least one of the printed labels in at least one of said rows.

3. An array of printed labels in accordance with claim 1 wherein said second portion of coded sense marks is comprised of a row of at least one selectively positioned sense mark associated with one of said rows of printed labels, said at least one selectively positioned sense mark identifying a particular column of said associated row of printed labels wherein said predetermined printed label is positioned.

4. An array of printed labels in accordance with claim 1 wherein each group of coded sense marks is aligned with the one row of printed labels wherein said predetermined printed label bearing said identified information is positioned.

* * * * *